US008947184B2

(12) United States Patent
Jongen et al.

(10) Patent No.: US 8,947,184 B2
(45) Date of Patent: Feb. 3, 2015

(54) COMPACT SUPERCONDUCTING CYCLOTRON

(71) Applicants: Yves Jongen, Louvain-la-Neuve (BE); Eric Forton, Chaussee de Namur (BE)

(72) Inventors: Yves Jongen, Louvain-la-Neuve (BE); Eric Forton, Chaussee de Namur (BE)

(73) Assignee: Ion Beam Applications, S.A., Louvain-la-Neuve (BE)

( * ) Notice: Subject to any disclaimer, the term of this patent is extended or adjusted under 35 U.S.C. 154(b) by 0 days.

(21) Appl. No.: 14/227,423

(22) Filed: Mar. 27, 2014

(65) Prior Publication Data

US 2014/0296075 A1 Oct. 2, 2014

(30) Foreign Application Priority Data

Mar. 29, 2013 (EP) ..... 13161884

(51) Int. Cl.
*H01F 1/00* (2006.01)
*H05H 13/00* (2006.01)

(52) U.S. Cl.
CPC ..... *H05H 13/005* (2013.01)
USPC ..... 335/216; 315/501; 315/502; 313/62

(58) Field of Classification Search
USPC ..... 335/216; 315/501–502; 313/62
See application file for complete search history.

(56) References Cited

U.S. PATENT DOCUMENTS

| | | | | |
|---|---|---|---|---|
| 4,996,496 | A * | 2/1991 | Kitamura et al. | 315/501 |
| 5,982,260 | A * | 11/1999 | Byrne | 335/216 |
| 7,656,258 | B1 | 2/2010 | Antaya et al. | |
| 2012/0126726 | A1 | 5/2012 | Antaya | |
| 2013/0009571 | A1 * | 1/2013 | Antaya | 315/502 |
| 2013/0270451 | A1 * | 10/2013 | Verbruggen et al. | 250/396 R |

FOREIGN PATENT DOCUMENTS

| | | |
|---|---|---|
| WO | WO 2012 055890 | 5/2012 |
| WO | WO 2013 006182 | 1/2013 |

OTHER PUBLICATIONS

European Search Report in European Patent Application No. EP 13 16 1884, mailed on Sep. 18, 2013 (4 pages).

Kubo T., et al., "Design of a model sector magnet for the RIKEN superconducting ring cyclotron", PAC 1997, IEEE Piscataway, NY, USA, vol. 3, May 12, 1997, pp. 3428-330, XP002674345.

* cited by examiner

*Primary Examiner* — Mary Ellen Bowman

(74) *Attorney, Agent, or Firm* — Finnegan, Henderson, Farabow, Garrett & Dunner, L.L.P.

(57) ABSTRACT

The present disclosure relates to a cyclotron. Embodiments of the present disclosure may include an upper and lower magnet pole, an upper and lower superconducting coil arranged around each of the magnetic poles, a ring-shaped magnetic return yoke, a beam chamber between the upper and lower magnetic poles having one or more electrodes configured to accelerate ions moving substantially in the median plane, and a cryostat. The ring-shaped magnetic return yoke and the coils may form a cold mass contained within the cryostat. Further, the cryostat may not contain the upper and lower poles.

6 Claims, 1 Drawing Sheet

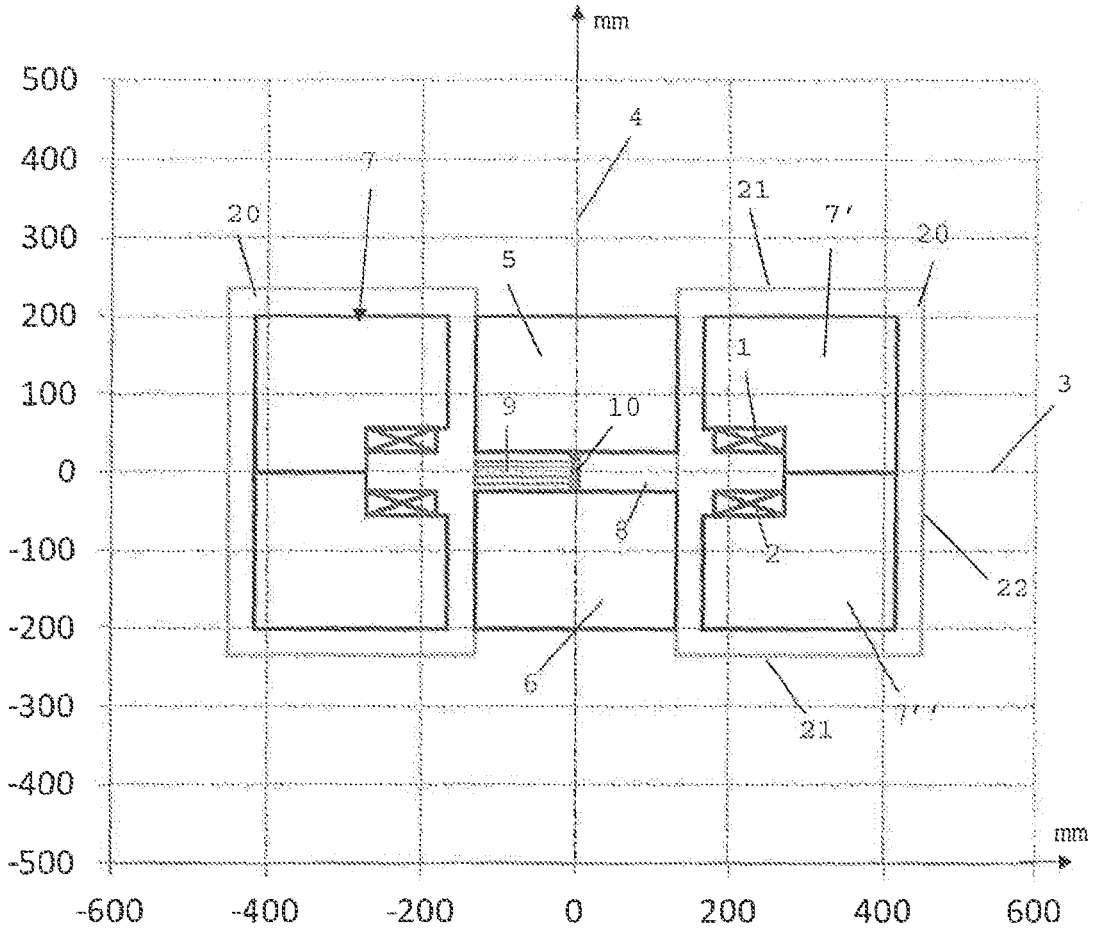
mm
500
400
300
200
100
0
-100
-200
-300
-400
-500
-600
-400
-200
0
200
400
600
mm
4
7
20
21
7'
20
5
1
3
9
10
8
2
22
6
21
7''

COMPACT SUPERCONDUCTING CYCLOTRON

CROSS-REFERENCE TO RELATED APPLICATION

This application is based upon and claims the benefit of priority from prior European Application No. 13161884.5, filed on Mar. 29, 2013, the entire contents of which are incorporated herein by reference.

TECHNICAL FIELD

The present disclosure is related to a circular ion accelerator, and more particularly to a compact superconducting cyclotron.

BACKGROUND

A typical magnetic structure of a superconducting cyclotron, illustrated for example in documents U.S. Pat. No. 7,656,258 and WO2012/055890, comprises a cold mass structure including at least two superconducting magnetic coils, i.e. magnetic coils which comprise a material that is superconducting below a nominal temperature. A cryostat generally encloses this cold mass structure and forms a vacuum chamber for keeping the cold mass structure under vacuum. The cold mass structure is cooled with one or more dry cryocooler units below the nominal temperature at which the magnetic coils are superconducting. A disadvantage of using a cryostat which encloses only the coils is that a plurality of openings must be provided in the magnetic structure, be it in the upper and lower part of the magnetic yoke (as in U.S. Pat. No. 7,656,258), or in the surrounding return yoke (as in WO2012/055890), for allowing the passage of the cryocooler units to the cryostat. These openings are increasing the technical complexity of the installation as well as representing a disturbance of the magnetic circuit. Further technical complexities in these designs follow from the requirement of a coil support (referred to as a bobbin), for supporting the coils and a plurality of tie rods for maintaining the coils in place within the cryostat. As an alternative to dry magnets and dry cryocoolers, wet magnets may be used also.

Another approach is to enclose the totality of the magnetic structure into the interior of a cryostat, as shown in document US2012/0126726. In this cyclotron, the cold mass includes the coils as well as the magnetic yoke structures above and below the coils. The beam chamber in which the ions accelerate under the influence of an alternating voltage must however be isolated from this cold mass, thus requiring a superinsulating layer between the magnetic poles and said beam chamber. The disadvantage of such an isolation layer is that it increases the magnetic gap between the poles of the magnetic structure, which in turn requires a higher pole radius in order to take into account magnetic field losses. Another drawback of the latter approach is that the poles cannot be dismounted during the magnetic mapping phase without opening the cryostat.

SUMMARY

Certain disclosed embodiments of the present disclosure relate to a cyclotron comprising: an upper and lower magnet pole, symmetrically placed with respect to a median plane, an upper and lower superconducting coil arranged around each of the magnetic poles, a ring-shaped magnetic return yoke, placed around the poles and the coils, configured to form a magnetic circuit, a beam chamber between the upper and lower magnetic poles, comprising one or more electrodes configured to accelerate ions moving substantially in the median plane, under the influence of a magnetic field oriented perpendicularly to the median plane, the field being generated by running an electric current through said coils, and a cryostat. In certain embodiments, the ring-shaped magnetic return yoke and the coils may form a cold mass contained within the cryostat, and the cryostat may not contain the upper and lower poles.

In certain embodiments, the cryostat may comprise a ring-shaped enclosure. The cryostat may comprise one or more openings configured to allow a cooler to gain access to the cold mass. The cyclotron may comprise a particle source arranged within the beam chamber. The cyclotron may also comprise an opening configured to receive a particle beam in the beam chamber, produced by an external beam source. The cyclotron may be an Azimuthally Varying Field isochronous cyclotron.

BRIEF DESCRIPTION OF THE DRAWING

FIG. 1 shows a conceptual cross-section of a cyclotron according to the invention. The dimensions indicated on the horizontal and vertical axes are in millimeters.

DETAILED DESCRIPTION

FIG. 1 is a schematic sectional view illustrating a preferred embodiment of a magnetic structure in a cyclotron according to the invention. The magnetic structure comprises two superconducting magnetic coils 1,2. These coils have an annular shape and are superimposed symmetrically with regard to the median plane 3 of the cyclotron. The two coils have a common central axis 4, which is also forming the central axial axis of the entire magnetic structure. In another embodiment (not shown) the coils are designed in such a way they touch each other in the median plane, in which case there may be only one coil. The magnetic structure comprises an upper pole 5 and a lower pole 6 or a plurality of both lower poles and upper poles 5/6 arranged azimuthally in sectors, and a ring-shaped return yoke 7, consisting of an upper portion 7' and a lower portion 7". The space between the poles contains the beam chamber 8, comprising at least one Dee-electrode 9 and an ion source 10, as known in the art. The Dee-electrode is connected to an RF voltage source for driving the ion acceleration in the beam chamber, as is also known in the art. The upper and lower poles 5/6 may be produced as 'valley-hill' poles, i.e. with alternating azimuthal sectors of higher and lower gaps between the poles or with separate valley poles and hill poles. In other words, the cyclotron may be an Azimuthally Varying Field (AVF) isochronous cyclotron.

Suitable extraction means (not shown, but known as such in the art) are present for extracting the beam from the beam chamber after a given number of accelerations within the beam chamber. As an alternative to a particle source 10 in the beam chamber, a means may be provided for providing access to the chamber to a beam produced by an external source, via an opening through an upper pole 5 for example.

What is specific to the cyclotron design of FIG. 1, is that the return yoke 7 and the coils 1/2 are contained in a ring-shaped cryostat 20. Generally, in a cyclotron of the invention, the cold mass is formed by said coils 1/2 and by the return yoke 7, whereas the poles 5/6 are not part of said cold mass.

The cryostat 20 may be produced as a ring-shaped enclosure, possibly assembled from an upper and lower half into which the upper and lower half 7'/7" of the return yoke and the upper and lower coils 1,2 are accommodated respectively. Cryocoolers (not shown) may be provided for cooling the cold mass within the cryostat via suitable access openings (not shown). Such access openings may be provided through the top or bottom surface 21 of the cryostat or through the cylindrical side surface 22. A vacuum is preferably created inside the cryostat. The details of the cryostat and components used in conjunction with it, such as the connection to the cryocoolers, the type of cryocoolers, the connection to a vacuum pump, the material of the cryostat enclosure etc may be brought into practice according to known cryostat designs used in cyclotron technology, for example as described in WO2012/055890.

In the radial direction, the coils 1,2 are supported by the return yoke portions 7', 7", as a consequence of the so-called 'hoop-stress', through which a magnetic coil tends to increase its diameter due to mutually repelling forces caused by current flowing through diametrically opposed sections of the coil. Axially, the two superposed coils 1, 2 may be locked in place by some material (not shown) between them. A non-magnetic material may be used, such as aluminium or a composite material.

One of the assets of the cyclotron according to the invention is that access from the RF power source to the electrodes 9 may take place axially through the poles 5/6, limiting the number of penetrations and holes in the cryostat. Radial access through the cryostat 20 remains nevertheless possible.

The components shown in FIG. 1 are preferably mounted in a housing that serves to maintain the components in the relative position shown in the drawing.

The cyclotron according to the invention provides a number of advantages:

- It avoids the problem of having to accommodate insulation in between the poles and the beam chamber, resulting in:
  - a smaller pole radius for a given extraction radius. Therefore this type of cyclotron can be more compact than existing machines
  - the possibility to get more flutter, decreasing the pole spiralization;
- It also allows installing cavities in the valleys, as is the case for classical 'valley/hill' machines, where the accelerated cavities are accommodated in the valley regions. When the poles are cold, as in the cyclotron described in U.S. Pat. No. 7,656,258 and WO2012/055890, the cryostat limits the acceleration chamber above and below, so that it is not possible to install the acceleration cavities.
- The poles can be dismounted during the mapping phase while coils are kept cold, significantly reducing the mapping time.
- The time to cool the coils is reduced compared to e.g. prior art WO2012/055890 because the poles are not inside the cryostat, limiting the total amount of material to be cooled.
- The coil-ring assembly inside the cryostat can be axially centered on the poles assembly because of the axial forces acting when they are not axially centered. Should there be some level of axial misalignment, it would be detected by the forces acting on the assembly.

The invention claimed is:

1. A cyclotron comprising:

an upper and lower magnet pole, symmetrically placed with respect to a median plane;

an upper and lower superconducting coil arranged around each of the magnetic poles;

a ring-shaped magnetic return yoke, placed around the poles and the coils, configured to form a magnetic circuit;

a beam chamber between the upper and lower magnetic poles, comprising one or more electrodes configured to accelerate ions moving substantially in the median plane, under the influence of a magnetic field oriented perpendicularly to the median plane, the field being generated by running an electric current through said coils; and a cryostat, wherein the ring-shaped magnetic return yoke and the coils form a cold mass contained within the cryostat, and wherein the cryostat does not contain the upper and lower poles.

2. The cyclotron of claim 1, wherein the cryostat comprises a ring-shaped enclosure.

3. The cyclotron of claim 2, wherein the cryostat comprises one or more openings configured to allow a cooler to gain access to the cold mass.

4. The cyclotron of claim 3, comprising:

a particle source arranged within the beam chamber.

5. The cyclotron of claim 3, comprising:

an opening configured to receive a particle beam in the beam chamber, produced by an external beam source.

6. The cyclotron of claim 1, wherein the cyclotron is an Azimuthally Varying Field isochronous cyclotron.

* * * * *